US007475555B2

(12) United States Patent
Janardhanam et al.

(10) Patent No.: US 7,475,555 B2
(45) Date of Patent: Jan. 13, 2009

(54) WATER DISPENSER ASSEMBLY AND METHOD OF ASSEMBLING SAME

(75) Inventors: Ramesh Janardhanam, Louisville, KY (US); Kenneth Hanley, Rochester Hills, MI (US); Abdel Hamad, Prospect, KY (US); John Kenneth Hooker, Louisville, KY (US); Anil Kumar Tummala, Louisville, KY (US); Natarajan Venkatakrishnan, Louisville, KY (US); Eric Paez, Louisville, KY (US); Eric Scott Johnson, Louisville, KY (US)

(73) Assignee: General Electric Company, Schenectady, NY (US)

( * ) Notice: Subject to any disclaimer, the term of this patent is extended or adjusted under 35 U.S.C. 154(b) by 371 days.

(21) Appl. No.: 11/258,657

(22) Filed: Oct. 26, 2005

(65) Prior Publication Data

US 2007/0089450 A1 Apr. 26, 2007

(51) Int. Cl.
*F25C 1/00* (2006.01)

(52) U.S. Cl. ..... 62/89; 62/340; 62/389; 222/146.6

(58) Field of Classification Search ..... 62/337–356, 62/389–400; 222/146.1–146.6
See application file for complete search history.

(56) References Cited

U.S. PATENT DOCUMENTS 3,765,569 A 10/1973 Rimini
4,150,767 A * 4/1979 Pitches et al. ..... 222/23
4,191,025 A 3/1980 Webb
4,433,701 A 2/1984 Cox et al.
4,520,950 A 6/1985 Jeans
4,793,513 A 12/1988 Verheijen
4,885,943 A 12/1989 Tootell et al.
5,124,934 A 6/1992 Kawamoto et al.
5,291,004 A 3/1994 Frank et al.
5,419,150 A 5/1995 Kaiser et al.
5,542,450 A 8/1996 King et al.
5,551,598 A 9/1996 Cutsinger
5,819,547 A 10/1998 Oh
5,911,744 A 6/1999 Kawaguchi
6,041,607 A * 3/2000 Kim ..... 62/188
6,093,312 A 7/2000 Boulter
6,354,342 B1 3/2002 Gagliano
6,550,642 B2 4/2003 Newman et al.
6,912,870 B2 * 7/2005 Gnadinger ..... 62/389
6,952,937 B2 * 10/2005 Choi et al. ..... 62/347
6,955,056 B1 * 10/2005 An et al. ..... 62/74
2006/0196212 A1 * 9/2006 Jenkins et al. ..... 62/340

* cited by examiner

*Primary Examiner*—William E Tapolcai
(74) *Attorney, Agent, or Firm*—George L. Rideout, Esq.; Armstrong Teasdale LLP

(57) ABSTRACT

A water dispenser assembly used for a dispensing system includes an inlet configured to receive water from a water supply, and a flow meter in communication with the inlet. The flow meter is configured to measure an amount of water passing therethrough. A first valve is arranged in communication with the flow meter, and the first valve is configured to enable and restrict water flow to an outlet. A controller is operatively coupled to the flow meter and the first valve. The controller is configured to control the dispensing of water based on the measured amount of water passing through the flow meter and based upon a volume error factor correction.

20 Claims, 4 Drawing Sheets

WATER DISPENSER ASSEMBLY AND METHOD OF ASSEMBLING SAME

BACKGROUND OF THE INVENTION

This invention relates generally to water dispenser assemblies, and more specifically, to appliances having water dispenser assemblies.

Appliances, such as refrigerators, generally include water dispenser assemblies. Known refrigerators include a housing defining a cabinet which is separated into a fresh food storage compartment and a freezer compartment, with a fresh food storage door and a freezer door rotatably hinged to an edge of the housing to provide access to the fresh food storage compartment and freezer compartment. The refrigerator also includes an ice maker received within the freezer compartment to produce ice pieces, a through-the-door dispenser configured to deliver the ice pieces outside the cabinet for a user's access, and a water supply arranged in communication with the ice maker to supply water therein.

However, known refrigerators do not provide a user with accurate control of water dispensing. Additionally, known refrigerators do not provide a user with selective modes of water dispensing to the ice maker. For example, the user sometimes desires to control the size of ice pieces produced by the ice maker. In addition, known refrigerators also do not provide the user with outside refrigerator access to a predetermined amount of water.

BRIEF DESCRIPTION OF THE INVENTION

In one aspect, a water dispenser assembly used for a dispensing system is provided including an inlet configured to receive water from a water supply, and a flow meter in communication with the inlet. The flow meter is configured to measure an amount of water passing therethrough. A first valve is arranged in communication with the flow meter, and the first valve is configured to enable and restrict water flow to an outlet. A controller is operatively coupled to the flow meter and the first valve. The controller is configured to control the dispensing of water based on the measured amount of water passing through the flow meter and based upon a volume error factor correction.

In another aspect, a refrigerator is provided. The refrigerator includes a cabinet, an ice maker arranged within the cabinet and configured to produce ice, and a water dispenser arranged within the cabinet and in communication with the ice maker. The water dispenser is configured to dispense an amount of water into the ice maker. A flow meter is operatively coupled to the water dispenser, and the flow meter is configured to accurately detect the amount of water dispensed into the ice maker. A controller is operatively coupled to the flow meter and the water dispenser, wherein the controller is configured to control the dispensing of water based on the measured amount of water passing through the flow meter and based upon a volume error factor correction.

In still another aspect, a method of assembling a water dispenser assembly used for a dispensing system is provided, wherein the method includes providing an inlet configured to receive water, providing a flow meter in communication with the inlet, wherein the flow meter configured to measure an amount of water passing therethrough, and providing a first valve arranged in communication with the flow meter. The first valve is configured to enable and restrict water flow to an outlet. The method also includes coupling a controller to the flow meter and the first valve, wherein the controller is configured to control the dispensing of water based on the measured amount of water passing through the flow meter and based upon a volume error factor correction.

DETAILED DESCRIPTION OF THE INVENTION

Figure 1:
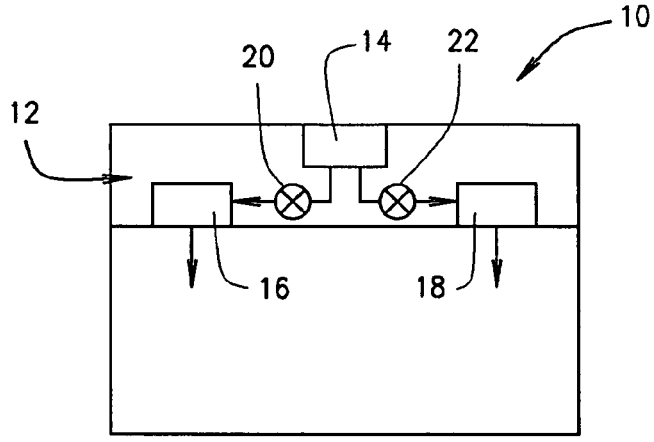
FIG. 1 is a schematic view of a water dispenser assembly for an appliance according to an exemplary embodiment of the present invention.

FIG. 1 is a schematic view of an appliance 10 having a water dispenser assembly 12. Appliance 10 includes known household or commercial grade appliances having a need for water dispenser assembly 12 such as, but not limited to, a refrigerator, a laundry appliance such as a washing machine, a dishwashing appliance, a water treatment appliance, a water dispensing appliance such as a countertop mounted water dispenser for delivering filtered water or hot water near a sink, and the like.

Water dispenser assembly 12 is coupled to appliance 10 for delivering and controlling an amount of water delivered to or from appliance 10. In an exemplary embodiment, water dispenser assembly 12 is programmable or variably selectable to deliver a predetermined amount of water. Water dispenser assembly 12 includes an inlet 14 coupled in flow communication with a plumbing supply line (not shown). Water dispenser assembly 12 also includes at least one outlet, such as first outlet 16 and second outlet 18. Valves 20 and 22 control the flow of water to outlets 16 and 18, respectively. In one embodiment, such as with the refrigerator or the water dispensing appliance, water is delivered to the user via outlets 16 and/or 18. In another embodiment, such as with the laundry appliance or the dishwashing appliance, water is delivered into the cabinet of the appliance via outlets 16 and/or 18.

Figure 2:
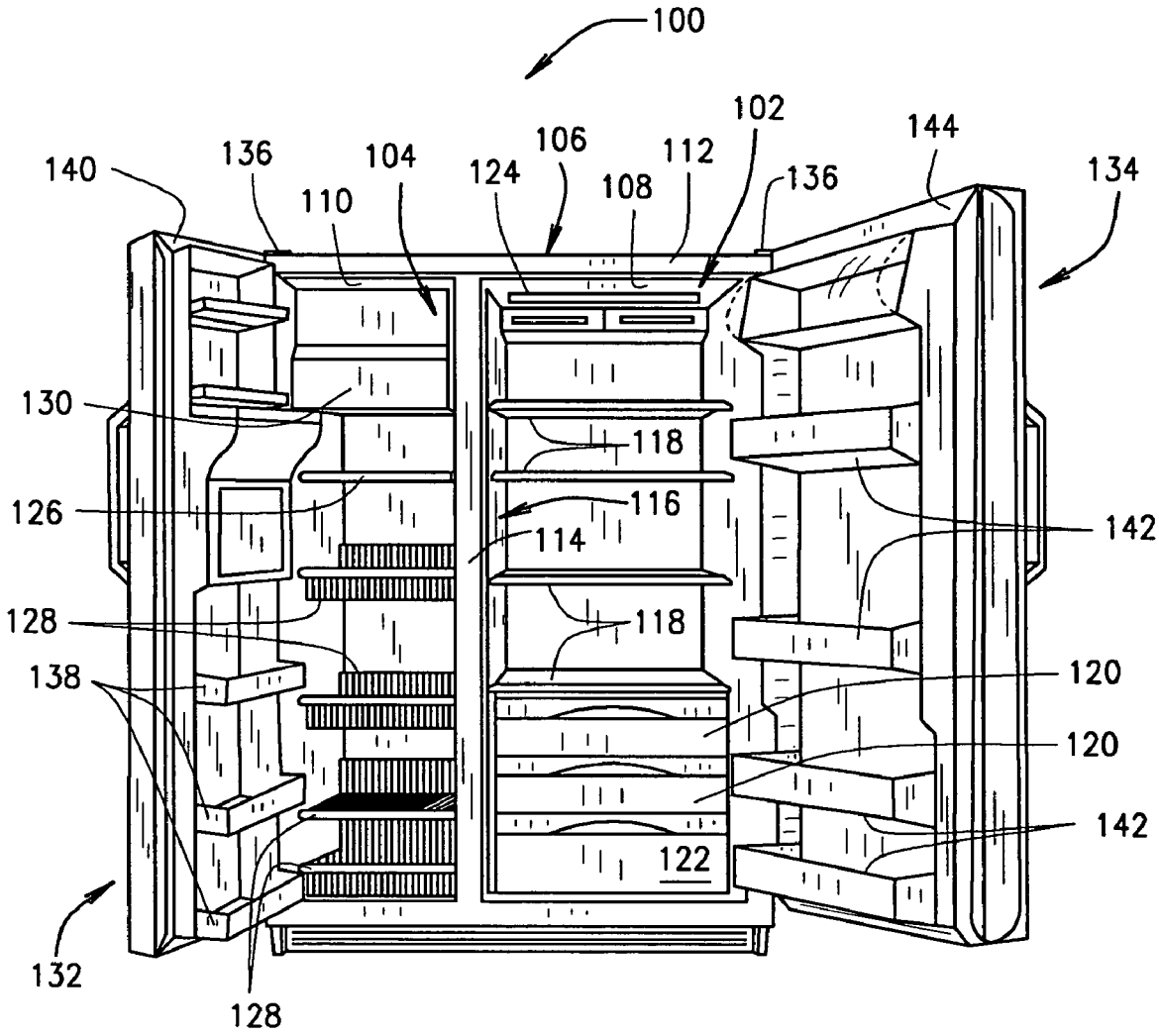
FIG. 2 illustrates a side-by-side refrigerator.

FIG. 2 illustrates an exemplary refrigerator 100. While the apparatus is described herein in the context of a specific refrigerator 100, it is contemplated that the herein described methods and apparatus may be practiced in other types of refrigerators. Therefore, as the benefits of the herein described methods and apparatus accrue generally to ice maker controls in a variety of refrigeration appliances and machines, the description herein is for exemplary purposes only and is not intended to limit practice of the invention to a particular refrigeration appliance or machine, such as refrigerator 100.

Refrigerator 100 includes a fresh food storage compartment 102 and freezer storage compartment 104. Freezer compartment 104 and fresh food compartment 102 are arranged side-by-side, however, the benefits of the herein described methods and apparatus accrue to other configurations such as, for example, top and bottom mount refrigerator-freezers. Refrigerator 100 includes an outer case 106 and inner liners 108 and 110. A space between case 106 and liners 108 and 110, and between liners 108 and 110, is filled with foamed-in-place insulation. Outer case 106 normally is formed by folding a sheet of a suitable material, such as pre-painted steel, into an inverted U-shape to form top and side walls of case. A bottom wall of case 106 normally is formed separately and attached to the case side walls and to a bottom frame that provides support for refrigerator 100. Inner liners 108 and 110 are molded from a suitable plastic material to form freezer compartment 104 and fresh food compartment 102, respectively. Alternatively, liners 108, 110 may be formed by bending and welding a sheet of a suitable metal, such as steel. The illustrative embodiment includes two separate liners 108, 110 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 112 extends between a case front flange and outer front edges of liners. Breaker strip 112 is formed from a suitable resilient material, such as an extruded acrylo-butadiene-styrene based material (commonly referred to as ABS).

The insulation in the space between liners 108, 110 is covered by another strip of suitable resilient material, which also commonly is referred to as a mullion 114. Mullion 114 also, in one embodiment, is formed of an extruded ABS material. Breaker strip 112 and mullion 114 form a front face, and extend completely around inner peripheral edges of case 106 and vertically between liners 108, 110. Mullion 114, insulation between compartments, and a spaced wall of liners separating compartments, sometimes are collectively referred to herein as a center mullion wall 116.

Shelves 118 and slide-out drawers 120 normally are provided in fresh food compartment 102 to support items being stored therein. A bottom drawer or pan 122 is positioned within compartment 102. A shelf 126 and wire baskets 128 are also provided in freezer compartment 104. In addition, an ice maker 130 is provided in freezer compartment 104. Ice maker 130 is supplied with water by a dispenser assembly, such as, for example, water dispenser assembly 12 (shown in FIG. 1)

A freezer door 132 and a fresh food door 134 close access openings to fresh food and freezer compartments 102, 104, respectively. Each door 132, 134 is mounted by a top hinge 136 and a bottom hinge (not shown) to rotate about its outer vertical edge between an open position, as shown in FIG. 2, and a closed position (shown in FIG. 3) closing the associated storage compartment. Freezer door 132 includes a plurality of storage shelves 138 and a sealing gasket 140, and fresh food door 134 also includes a plurality of storage shelves 142 and a sealing gasket 144.

Figure 3:
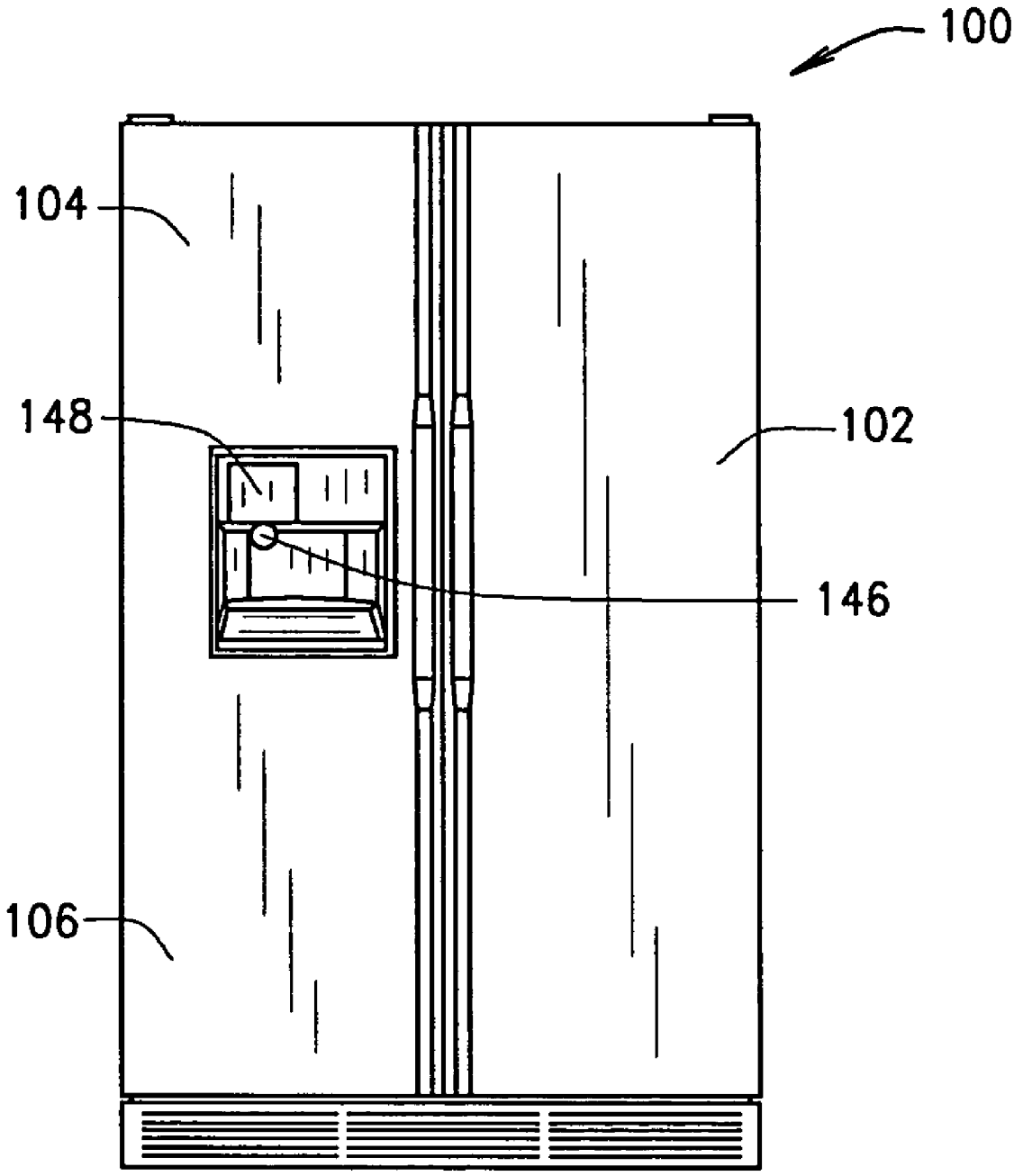
FIG. 3 is front view of the refrigerator of FIG. 2.

FIG. 3 is a front view of refrigerator 100 with doors 102 and 104 in a closed position. Freezer door 104 includes a through the door dispenser 146, and a user interface 148. Dispenser 146 is supplied water by a dispenser assembly, such as, for example, water dispenser assembly 12 (shown in FIG. 1). Additionally, dispenser 146 is supplied ice by from ice maker 130 via a chute (not shown).

In use, and as explained in greater detail below, a user enters an input, such as, for example, a desired amount of water or a desired ice cube size, using interface 148, and the desired amount is dispensed by dispenser 146. For example, a recipe calls for certain amount of water (e.g., ⅓ cup, ½ cup, 1 tablespoon, 2 teaspoons, 6 ounces, etc.), and instead of using a measuring cup, the user can use any size container (large enough to hold the desired amount) by entering the desired amount using interface 148, and receiving the desired amount via dispenser 146. Dispenser 146 also dispenses ice cubes. A user may control a size of the ice cubes. In one embodiment, by selecting a smaller size ice cube, the ice cubes may be formed more quickly.

Figure 4:
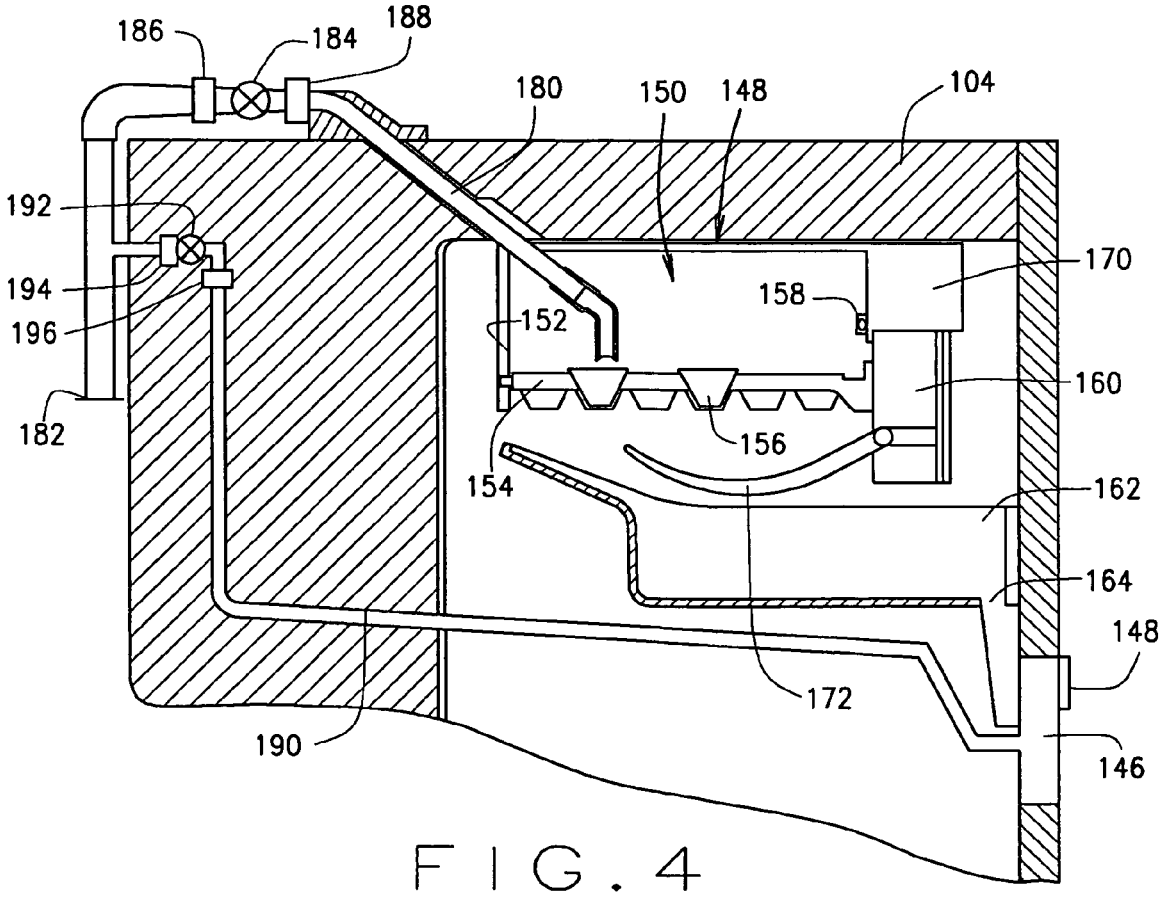
FIG. 4 is a cross sectional view of an exemplary ice maker using the water dispenser assembly.

FIG. 4 is a partial cross-sectional view of ice maker 150 including a water dispenser assembly. Ice maker 150 includes a metal mold 152 with a bottom wall 154 in which a plurality of cavities are defined to form ice pieces 156 when water flows successively to each cavity. In the exemplary embodiment, a water level detector 158 is mounted on an inner sidewall of ice maker 150 at a predetermined height to indicate the filled water level. To remove ice pieces 156 formed in the cavities in metal mold 152, bottom wall 154 is rotatably connected to a motor assembly 160 that reverses together with bottom wall 154 to get ice pieces 156 removed from cavities to a storage bucket 162 when ice pieces 156 are formed. Storage bucket 162 is located below ice maker 150. An outlet opening 164 is defined through the bottom of storage bucket 162 and is in communication with chute 146 through fresh food door 112 when fresh food door 112 is in a closed position.

Operation of motor assembly 160 and ice maker 150 are effected by a controller 170 operatively coupled to motor assembly 160 and ice maker 150. Controller 170 operates ice maker 150 to refill mold 152 with water for ice formation after ice is harvested. In order to sense the level of ice pieces 156 in storage bin 168, a sensor arm 172 is operatively coupled to controller 170 for controlling an automatic ice harvest so as to maintain a selected level of ice in storage bucket 162. Sensor arm 172 is rotatably mounted at a predetermined position on motor assembly 160 to sense a level of ice pieces 156 into which ice pieces 156 are harvested and delivered from metal mold 152. Sensor arm 172 is automatically raised and lowered during operation of ice maker 150 as ice is formed. Sensor arm 172 is spring biased to a lower position that is used to determine initiation of a harvest cycle and raised by a mechanism (not shown) as ice is harvested to clear ice entry into storage bucket 162 and to prevent accumulation of ice above sensor arm 172 so that sensor arm 172 does not move ice out of storage bucket 162 as sensor arm 172 raises. When ice obstructs sensor arm 172 from reaching its lower position, controller 170 discontinues harvesting because storage bucket 162 is sufficiently full. As ice is removed from storage bucket 162, sensor arm 172 gradually moves to its lower position, thereby indicating a need for more ice and causing controller 170 to initiate a fill operation as described in more detail below.

To supply water to ice maker 150 for making ice, first water dispenser 180 is in communication with a water source 182 and ice maker 150. A first water valve 184 is coupled to first water dispenser 180 and is also operatively coupled to controller 170. A sensor 186, such as, for example, a flow meter, is used to detect a volume of water flowing through water dispenser 180 into ice maker 150. Flow meter 186 may be coupled to one of water source 182, water valve 184, or the outlet into ice maker 150. Flow meter 186 is configured to measure the amount of water passing through flow meter 186. Flow meter 186 is also operatively coupled to controller 170 which is configured to receive a signal indicating the quantity of water passing though flow meter 186. A second sensor 188, such as, for example, a pressure sensor, is also used to measure the pressure of the water flowing past flow meter 186. Pressure sensor 188 may be positioned immediately upstream of, immediately downstream of, or remote with respect to flow meter 186 for detecting the pressure of the water.

In the exemplary embodiment, a second water dispenser 190 is in communication with water source 182 and dispenser 146. A second water valve 192 is coupled to second water dispenser 190 and is operatively coupled to controller 170. Second water valve 192 controls the flow of water through second water dispenser 190. A sensor 194, such as, for example, a flow meter, is configured to measure the amount of water flowing through second water dispenser 190. Flow meter 194 is also operatively coupled to controller 170 which is configured to receive a signal indicating the quantity of water passing though flow meter 194. Controller 170 may operate valve 192 based upon the signal from flow meter 194. Flow meter 194 may be coupled to one of water source 182, water valve 184, or the outlet at dispenser 146. As such, in one embodiment, a single flow meter 186 or 194 may be used to measure the amount of water channeled to both first and second water dispensers 180 and 190, such as, for example, by coupling flow meter 186 proximate water source 182. Alternatively, multiple flow meters 186 and 194 are used to independently measure the flow through first and second water dispensers 180 and 190, respectively. A second sensor 196, such as, for example, a pressure sensor, is also used to measure the pressure of the water flowing past flow meter 194. Pressure sensor 196 may be positioned immediately upstream of, immediately downstream of, or remote with respect to flow meter 194 for detecting the pressure of the water.

Figure 5:
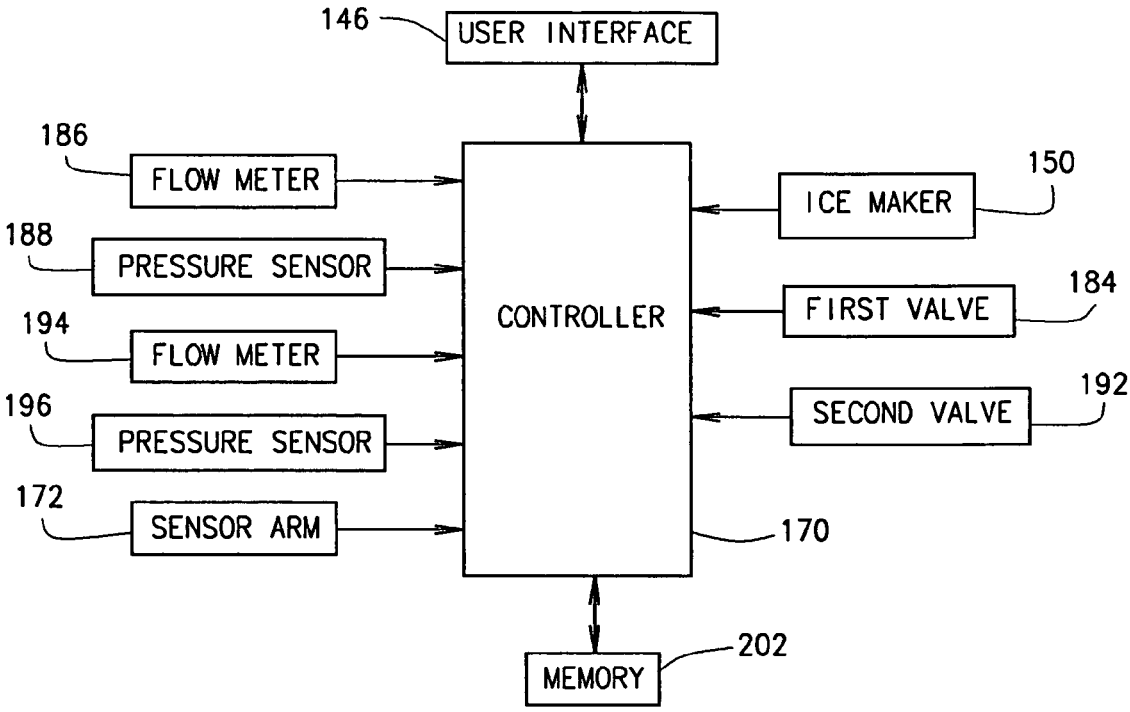
FIG. 5 is a schematic view of a control system for use with the appliance shown in FIG. 1.

FIG. 5 is a control system 200 for use with refrigerator 100 shown in FIG. 2. Controller 170 is operatively coupled to flow meters 186 and 194, pressure sensors 188 and 196, user interface 148, water level detector 158, sensor arm 172, first water valve 184, second water valve 192, and a memory element 202. Controller 170 is programmed to operate the above mentioned components. In the exemplary embodiment, controller 170 can be implemented as a microprocessor. The term microprocessor as used hereinafter is not limited just to microprocessors, but broadly refers to computers, processors, microcontrollers, microcomputers, programmable logic controllers, application specific integrated circuits, and other programmable logic circuits, and these terms are used interchangeably herein.

In the exemplary embodiment, each flow meter 186 and 194 includes a rotating element (not shown), a magnet (not shown) mounted to the rotating element, and a circuit with a reed switch (not labeled) placed relative to the rotating element such that every time a magnet passes close to the reed switch, a circuit is completed and a pulse is generated. A programmable logic controller (PLC) with a high speed counter (not labeled) is utilized with the reed switch such that an exact amount of water passing through flow meter 186 can be calculated.

In use, water can be dispensed into ice maker 150 in different modes. In a first mode, a user can select a predetermined amount of water dispensed into ice maker 150. Specifically, the user enters a desired amount of water or a desired ice cube size using user interface 148. Controller 170 then initiates a water fill into ice maker 150 from water source 182, through flow meter 186 and first water valve 184. As flow meter 186 senses that the quantity of water reaches the preselected amount, a signal is sent to controller 170. Controller 170 then sends a signal to first water valve 184 to close. As such, no more water is supplied to ice maker 150. Afterwards, a predetermined size of ice cubes will be made, since the size of ice pieces or ice cubes depends on the amount of water supplied into metal mold 152 of ice maker 150. As a result, under-filling or over-filling of the ice maker will be avoided. In addition, the user can obtain the desired size of ice pieces.

In a second mode, the user may select a continuous fill, wherein controller 170 will command water valve 184 to open, thereby allowing water to flow into ice maker 150 continuously until water level detector 158 informs controller 170 that the water level in ice maker 150 has reached an upper limit. Then, controller 170 will instruct water valve 184 to close to prevent any water from being supplied.

In another exemplary embodiment, a desired amount of water can be discharged from dispenser 146 by second water dispenser 190. For example, a recipe calls for a certain amount of water (e.g., a teaspoon, a table teaspoon, ¼ cup, ⅓ cup, ½ cup, 1 cup, 2 cups, etc.), and instead of using a measuring cup, the user can use any size container (large enough to hold the desired amount) by entering the desired amount using user interface 148. Then, controller 170 opens second water valve 192, allowing water to flow into the user's container. In a second mode, the user may desire a continuous flow of water to dispenser 146. Controller 170 leaves valve 192 open until the user stops demanding water.

Figure 6:
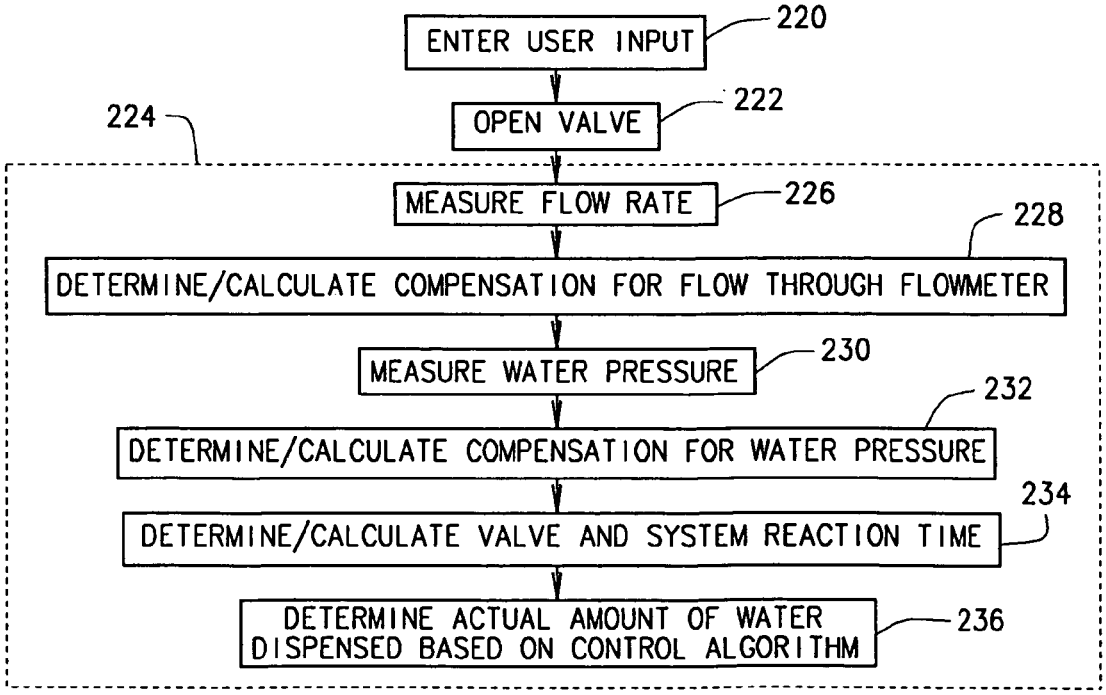
FIG. 6 is a flow diagram showing an exemplary control method for the water dispenser assembly shown in FIG. 1.

FIG. 6 is a flow diagram showing an exemplary control method for water dispenser assembly 12 (shown in FIG. 1). A user input is entered 220 at user interface 148 (shown in FIG. 3). For example, a user selects a desired amount of water, a fill level, or a desired ice cube size via a keypad or tactile button. Alternatively, a user may depress a dispensing paddle to demand water or ice. A signal relating to the user input is sent to controller 170 (shown in FIGS. 4 and 5). Controller 170 then operates the various components of appliance 10 based on the user input entered 220. For example, controller opens 222 valve 20 or 22, and in the particular embodiment of refrigerator 100, controller opens 22 valve 184 or 192. When valve 184 or 192 is opened, water flows through first or second water dispensers 180 or 190, respectively.

The volume of water flowing through water dispenser 180 or 190 is measured or calculated 224. For example, flow meter 186 or 194, respectively, may be utilized to measure 226 a flowrate of water flowing through water dispenser 180 or 190. Once the flowrate is measured, a compensation value for the flowrate through flow meter 186 or 194 is determined or calculated 228. The compensation value may be determined based on a formula or the compensation value may be determined based on a look-up table. Additionally, in one embodiment, a pressure of the water flowing through water dispenser 180 or 190, such as, for example, at an inlet, is measured 230. For example, pressure sensor 188 or 196, respectively, may be utilized to measure the pressure of water flowing through water dispenser 180 or 190 past flow meter 186 or 194. Once the pressure of the water is measured 230, a compensation value for the water pressure is determined or calculated 232. The compensation value may be determined based on a formula or the compensation value may be determined based on a look-up table. In one embodiment, a valve or system reaction time is determined or calculated 234.

Once the various values are measured or calculated, the actual or adjusted amount of water dispensed is determined or calculated 236 based on a control algorithm. In one embodiment, the control algorithm uses the measured 226 flowrate, the measured pressure 230, error factor compensation values, such as the compensation values determined at 228 and 232, and the valve or system reaction time value determined at 234 to adjust the measured volume to an adjusted volume. Controller 170 operates valve 184 or 192 based on the adjusted volume. In one embodiment, the error factor is based on the measured pressure of the water. For example, flow meter 186 or 194 may measure different or inaccurate volumes based on the pressure of the water. For example, higher pressures of water may lead to an underestimate in the volume of water dispensed. Alternatively, lower pressures of water may lead to an overestimate in the volume of water dispensed. Additionally, the pressure of water may change during filling based on other water demands within water dispenser assembly 12, or external to water dispenser assembly 12. Use of the error factor correction provides a more accurate measure of the amount of water dispensed from first or second water dispensers 180 or 190.

Refrigerator 100 provides a user selective modes of dispensing water into ice maker 150 such that the ice making process can be controlled by the user who sometimes desires to effectively control the size of the ice pieces or ice cubes. In addition, refrigerator 100 also provides the user with an option to dispense a predetermined amount of water in a cost effective and reliable manner.

While the invention has been described in terms of various specific embodiments, those skilled in the art will recognize that the invention can be practiced with modification within the spirit and scope of the claims.

What is claimed is:

1. A water dispenser assembly used for a dispensing system, said water dispensing assembly comprising:

an inlet configured to receive water from a water supply;

a flow meter in communication with said inlet, said flow meter configured to measure a volume of water passing therethrough;

a first valve arranged in communication with said flow meter, said first valve configured to enable and restrict water flow to an outlet; and a controller operatively coupled to said flow meter and said first valve, said controller programmed to control said first valve to dispense an adjusted volume of water from said outlet by compensating for the measured volume of water passing through said flow meter with a volume error factor correction.

2. The water dispenser assembly in accordance with claim 1 wherein the volume error factor correction is based upon at least one of a pressure, a flowrate, and a system reaction time.

3. The water dispenser assembly in accordance with claim 1 further comprising a pressure sensor configured to measure a pressure of water within said dispensing system, said pressure sensor operatively coupled to said controller, said volume error factor correction based upon the measured pressure of the water.

4. The water dispenser assembly in accordance with claim 1 further comprising a second valve arranged in communication with one of said flow meter and a second flow meter, said second valve operatively coupled to said controller, said second valve configured to enable and restrict the water to flow to a second outlet.

5. The water dispenser assembly in accordance with claim 4 wherein the dispensing system is coupled to a refrigerator comprising a first through-the-door dispenser configured to deliver ice from an ice maker to a user and a second through-the-door dispenser configured to deliver water to a user, wherein said outlet is configured to deliver water to the ice maker, said second outlet is configured to deliver water to said second through-the-door dispenser.

6. The water dispenser assembly in accordance with claim 1 further comprising a second water dispenser operatively coupled to said flow meter.

7. The water dispenser assembly in accordance with claim 1 further comprising a second water dispenser comprising a second flow meter operatively coupled to the controller and configured to measure a volume of water passing through the second flow meter, the controller further programmed to control a second valve to dispense water.

8. The water dispenser assembly in accordance with claim 1 further comprising a user interface operatively coupled to said controller and configured to receive an input from a user.

9. The water dispenser assembly in accordance with claim 8 wherein said user interface comprises a plurality of tactile buttons configured to allow a user to select different amounts of water to be dispensed.

10. A refrigerator comprising:

a cabinet;

an ice maker arranged within said cabinet, said ice maker configured to produce ice;

a water dispenser arranged within said cabinet and in communication with said ice maker, said water dispenser configured to dispense a volume of water into said ice maker;

a flow meter operatively coupled to said water dispenser, said flow meter configured to accurately detect the volume of water dispensed into said ice maker; and a controller operatively coupled to said flow meter and said water dispenser, said controller programmed to control a valve to dispense an adjusted volume of water into said ice maker by compensating for the measured volume of water passing through said flow meter with a volume error factor correction.

11. The refrigerator in accordance with claim 10 wherein the volume error factor correction is based upon at least one of a pressure, a flowrate, and a system reaction time.

12. The refrigerator in accordance with claim 10 further comprising a pressure sensor configured to measure a pressure of water within said dispensing system, said pressure sensor operatively coupled to said controller, said volume error factor correction based upon the measured pressure of the water.

13. The refrigerator in accordance with claim 10 further comprising a second water dispenser operatively coupled to said flow meter.

14. The refrigerator in accordance with claim 10 further comprising a second water dispenser comprising a second flow meter.

15. The refrigerator in accordance with claim 10 further comprising a first valve and a second valve, said first valve configured to control passage of water flowing into said ice maker, said second valve configured to control passage of water flowing outside said cabinet of the refrigerator, said first and second valves operatively coupled to said controller and controlled based upon an amount of water dispensed therefrom.

16. The refrigerator in accordance with claim 10 further comprising a user interface operatively coupled to said controller and configured to receive an input from a user, wherein said user interface comprises a plurality of tactile buttons configured to allow a user to select different amounts of water to be dispensed.

17. A method of assembling a water dispenser assembly used for a dispensing system, said method comprising:

providing an inlet configured to receive water;

providing a flow meter in communication with the inlet, the flow meter configured to measure a volume of water passing therethrough;

providing a first valve arranged in communication with the flow meter, the first valve being configured to enable and restrict water flow to an outlet; and coupling a controller to the flow meter and the first valve, the controller programmed to control the first valve to dispense an adjusted volume of water by compensating for the measured volume of water passing through the flow meter with a volume error factor correction.

18. The method in accordance with claim 17 wherein said coupling a controller to the flow meter and the first valve further comprises coupling a controller to the flow meter and the first valve, the controller programmed to control the first valve based upon at least one of a pressure, a flowrate, and a system reaction time.

19. The method in accordance with claim 17 further comprising providing a pressure sensor configured to measure a pressure of water within the dispensing system, said coupling a controller to the flow meter and the first valve further comprises coupling a controller to the flow meter and the first valve, the controller programmed to control the first valve based upon the measured pressure of the water.

20. The method in accordance with claim 17 further comprising:

providing a second valve arranged in communication with one of the flow meter and a second flow meter;

operatively coupling the second valve to the controller, the second valve being configured to enable and restrict the water to flow to a second outlet.

* * * * *